US009889867B2

(12) United States Patent
Johnson

(10) Patent No.: US 9,889,867 B2
(45) Date of Patent: Feb. 13, 2018

(54) RAILROAD SWITCH MACHINE

(71) Applicant: ALSTOM TRANSPORT TECHNOLOGIES, Saint-Ouen (FR)

(72) Inventor: Bruce V. Johnson, Pittsford, NY (US)

(73) Assignee: Alstom Transport Technologies, Saint-Ouen (FR)

( * ) Notice: Subject to any disclaimer, the term of this patent is extended or adjusted under 35 U.S.C. 154(b) by 219 days.

(21) Appl. No.: 14/980,861

(22) Filed: Dec. 28, 2015

(65) Prior Publication Data

US 2017/0183021 A1 Jun. 29, 2017

(51) Int. Cl.
*B61L 5/06* (2006.01)

(52) U.S. Cl.
CPC ..... *B61L 5/06* (2013.01)

(58) Field of Classification Search
CPC ..... B61L 5/00; B61L 5/02; B61L 5/06; B61L 5/063; B61L 5/067
See application file for complete search history.

(56) References Cited

U.S. PATENT DOCUMENTS 3,696,244 A * 10/1972 Hamley ..... B61L 5/062 246/242 R
4,756,494 A * 7/1988 Kondratenko ..... B61L 5/062 246/242 R
5,160,875 A * 11/1992 Kono ..... H02P 3/12 318/258
5,412,369 A * 5/1995 Kirchner ..... H02J 13/0031 375/355
5,806,809 A * 9/1998 Danner ..... B61L 5/107 246/220
5,852,350 A * 12/1998 LeVoir ..... B61L 29/02 246/125
6,366,041 B1 * 4/2002 Bozio ..... B61L 7/083 246/132
8,348,202 B2 * 1/2013 Franke ..... B61L 1/20 246/242 R
9,592,843 B2 * 3/2017 Mariuzza, Jr. ..... B61L 5/107
2017/0183021 A1 * 6/2017 Johnson ..... B61L 5/06

* cited by examiner

*Primary Examiner* — Jason C Smith
(74) *Attorney, Agent, or Firm* — Knobbe, Martens, Olson & Bear, LLP

(57) ABSTRACT

A railroad switch machine includes a pair of switch blades, an electric motor mechanically coupled to the pair of switch blades, a pair of input terminals connected to a DC power supply for receiving a power signal and a regulator to adapt the power signal between the input terminals into a motor current applied to the electric motor. The regulator includes a plurality of switches connected between the pair of input terminals and two phases of the electric motor. The switches are transistors and the regulator also includes a controller adapted to drive each transistor with a respective command signal to adjust a value and a direction of an intensity of the motor current.

11 Claims, 6 Drawing Sheets

RAILROAD SWITCH MACHINE

FIELD OF THE INVENTION

The present invention concerns a railroad switch machine.

BACKGROUND

Railroad switch machines are key elements of a railroad installation. A railroad switch machine has to operate over extreme temperatures and is subject to intense shock and vibration. Maintenance of a switch machine may take place in difficult and potentially dangerous conditions, and is a significant expense for a railroad operator because of the large number of switch machines used. Therefore it is important to minimize the required maintenance for the switch machines, while optimizing their reliability and maintaining their performance over time.

Switch machines typically utilize a DC permanent magnet motor to drive a gearbox, whose output is coupled to a mechanical apparatus for moving switch blades of the track. Such switch machines are typically powered by a DC voltage source from a railroad wayside equipment station, and comprise high current contactors powering and driving the DC permanent magnet motor.

The switch machines presented above include, in the gear box, a mechanical torque-limiting clutch. The torque-limiting clutch is adjusted to slip when motor torque exceeds a certain predetermined limit, in order to maintain a good and secured operating of the motor and more generally of the switch machine. One of the main reasons a mechanical clutch is required in switch machines is that track obstacles such as rocks or ice could block normal rail switch motion, in which case the motor could stall. Since the motors in the switch machines presented above are driven by a fixed voltage, the lack of counter electromotive force in the motor windings during a motor stall condition will cause motor current and corresponding motor torque to increase to a very high level. This could damage the motor and/or the switch machine mechanism.

However the use of a torque-limiting clutch has drawbacks. Indeed, the torque-limiting clutch does not provide a precise motor torque control and is also relatively large and expensive. The performance of the mechanical clutch will change with environmental conditions (e.g. temperature and humidity), and will also change over time as the mechanical parts wear and corrosion occurs.

Moreover, periodic maintenance is required for the high current contactors and for the torque-limiting clutch to ensure proper operation of the switch machine.

Besides, it is known from the U.S. Pat. No. 6,366,041 B1 a switch machine comprising switch blades, a motor for moving the switch blades, and a regulation unit to control the electric power supplied to the motor so as to command the movement of the switch blades from an initial position to a final position. In such switch machine, the regulation unit includes high current contactors and a control device of the contactors.

However, in such a switch machine, the regulation unit does not provide a precise control of the motor and a periodic maintenance of the contactors is required. Indeed the contactors are subject to significant mechanical wear because of arcing.

SUMMARY OF THE INVENTION

Embodiments of the present invention provide a response to the drawbacks mentioned above.

In one embodiment, a railroad switch machine comprises:

- a pair of switch blades,
- an electric motor, the electric motor being a reversible motor having two phases, the electric motor being mechanically coupled to the pair of switch blades to move the switch blades relative to a pair of stationary rails,
- a pair of input terminals, connected to a DC power supply for receiving a power signal,
- a regulation unit to adapt the power signal between the input terminals into a motor current applied to the electric motor, said regulation unit comprising several switch elements connected in an H bridge configuration between the pair of input terminals and the two phases of the electric motor,
- wherein the switch elements are transistors and the regulation unit comprises a control device adapted to drive each transistor with a respective command signal to adjust a value and a direction of an intensity of the motor current.

According to further aspects of the invention, which are advantageous but not compulsory, such a railroad switch machine may incorporate one or several of the following features:

- each respective command signal is a pulse width modulation signal;
- the regulation unit comprises a motor current sensor configured to measure the intensity of the motor current applied to the electric motor and the control device drives each transistor in function of the intensity of the motor current, to regulate the intensity of the motor current supplied to the electric motor;
- the control device is adapted to drive each transistor also in function of a predetermined motor current limit setpoint, to limit the intensity of the motor current below the predetermined motor current limit setpoint, providing a feedback control of the intensity of the motor current;
- the electric motor is intended to move the switch blades relative to stationary rails from an initial position to a final position, the regulation unit comprising identifying means to identify an instantaneous state of the railroad switch machine among:
  - a starting state, during which the motor starts to spin and the switch blades have traveled relative to the stationary rails on a first distance comprised in a first interval,
  - a normal operating state, during which the switch blades have traveled relative to the stationary rails on a second distance comprised in a second interval following the first interval, and
  - an ending state, during which the switch blades have traveled relative to the stationary rails on a third distance comprised in a third interval following the second interval,
  - and the control device is configured to adapt the value of the predetermined motor current limit setpoint, depending on the instantaneous state of the electric motor;
- during the normal operating state the control device drives each transistor to connect the electric motor to the input terminals continuously, in order to apply a voltage of maximum absolute value to the electric motor;
- during the starting and ending operating states the control device drives each transistor to limit motor current to the predetermined motor current limit setpoint;

the regulation unit comprises a supply current sensor configured to measure an intensity of the power signal received on the input terminals, the control device drives each transistor also in function of the intensity of the power signal, the regulation unit comprising a first feedback loop on the intensity of the motor current and a second feedback loop on the intensity of the power signal, the regulation unit thus forming a cascade controller;

the railroad switch machine includes a capacitor connected in parallel with the input terminals;

the regulation unit, the motor and the capacitor forms a buck DC-DC converter devoid of independent inductor and an internal inductance of the electric motor is used as an inductor for the buck DC-DC converter; and the railroad switch machine is devoid of a mechanical torque-limiting clutch.

DETAILED DESCRIPTION

Figure 1:
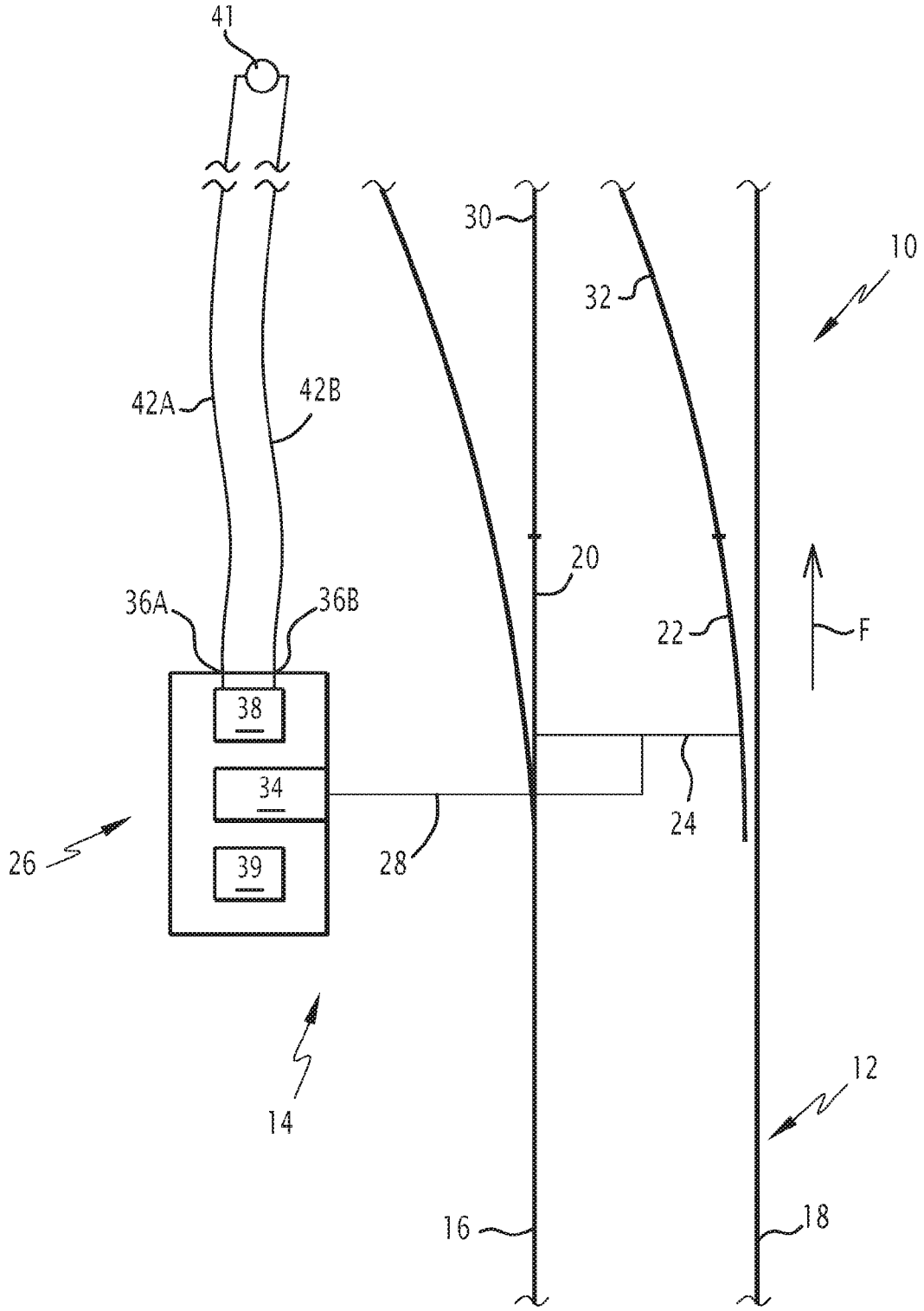
FIG. 1 represents schematically a railroad installation comprising a railroad track and a railroad switch machine according to a first embodiment of the invention.

FIG. 1 shows a railroad switch installation 10 which comprises a railroad track 12 and a railroad switch machine 14 installed on the railroad track.

The railroad track 12 comprises a stationary left rail 16 and a stationary right rail 18.

The stationary left rail 16 defines a deviated way for a vehicle traveling on the railroad track 12 in a predetermined flow direction F and the stationary right rail 18 defines a direct way for a vehicle traveling on the railroad track 12 in the predetermined flow direction F.

The switch machine 14 includes a left switch blade 20 and a right switch blade 22 which are linked by one tie rod 24.

The switch machine 14 comprises also a motor assembly 26 and a displacement element 28 linking the motor assembly 26 to the tie rod 24. The motor assembly 26 and the displacement element 28 are configured to move the tie rod 24 and therefore the left 16 and right 18 switch blades to guide a non-represented vehicle, such as a train, crossing the switch blades in the predetermined flow direction F, either in the direct way or in the deviated way.

More especially, the motor assembly 26 and the displacement element 28 are intended to move the left 20 and right 22 switch blades relative to the left 16 and right 18 stationary rails between a direct position, wherein a vehicle crossing the switch blades 20, 22 is guided to the direct way and a deviated position, wherein a vehicle crossing the switch blades 20, 22 is guided to the deviated way.

In the direct position, illustrated on FIG. 1, the left switch blade 20 is positioned against the stationary left rail 16, and the right switch blade 22, is away from the stationary right rail 18, i.e. separated from the stationary right rail 18 by a free space of, for example, 10 cm.

In the direct position, the vehicle is directed to the direct way, via the right stationary rail 18 and the left switch blade 20, which is extended by a straight left rail 30 extending along the direct way sensibly parallel to the right stationary rail 18.

In the deviated position, not shown, the left switch blade 20 and the right switch blade 22 are moved to the right with respect to FIG. 1, the left switch blade 20 moving away from the stationary left rail 16 and the right switch blade 22 moving to a position against the stationary right rail 18.

In the deviated position, the vehicle is directed to the deviated way, via the left stationary rail 16 and the right switch blade 22, which is extended by a deviated right rail 32 extending along the deviated way, sensibly parallel to the left stationary rail 16.

Figure 2:
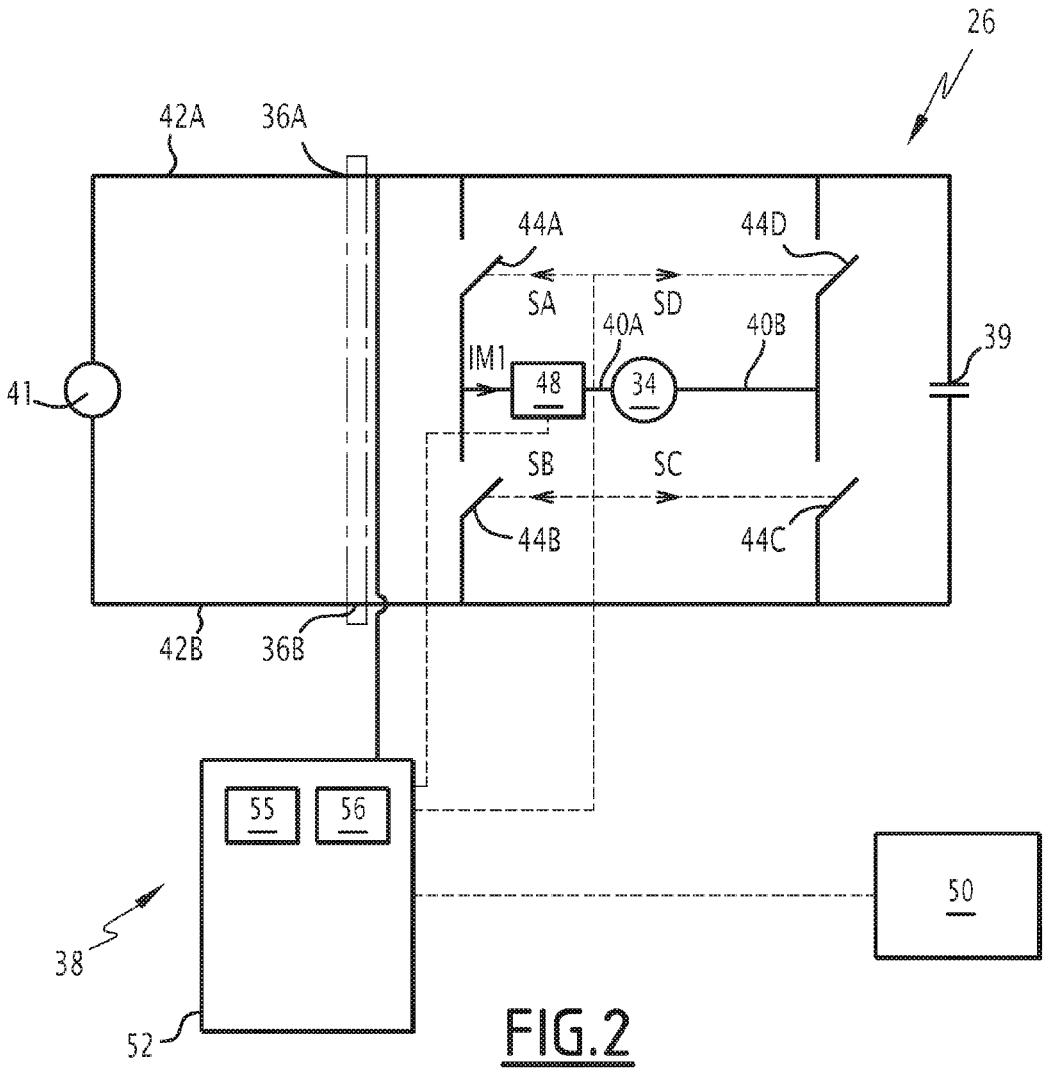
FIG. 2 represents a motor assembly of the railroad switch machine of FIG. 1 comprising an electric motor and a regulation unit for the electric motor.

As represented on FIGS. 1 and 2, the motor assembly 26 comprises a reversible electric motor 34, whose output is connected to the displacement element 28 through a non-represented gear box, two input terminals 36A, 36B connected to a direct current (DC) power supply 41, a regulation unit 38 configured to drive the motor 34 and a capacitor 39 connected in parallel with the input terminals 36A, 36B.

The motor assembly 26, and more generally the railroad switch machine 14, is devoid of a mechanical torque-limiting clutch adapted to slip when a motor torque produced by the electric motor 34 exceed a predetermined value.

The motor assembly 26, i.e. the regulation unit 38, the motor 34 and the capacitor 39, forms a buck DC-DC converter devoid of independent inductor. More especially, an internal inductance of the electric motor is used as an inductor for the buck DC-DC converter.

The electric motor 34 moves the displacement element 28 while the electric motor 34 is spinning.

The electric motor 34 is a two-phase motor and is, for example, a DC brush motor.

The electric motor 34 comprises a first phase 40A and a second phase 40B.

Alternatively, the electric motor 34 is a brushless DC servomotors or a field-wound motor.

As presented above, the electric motor 34 is mechanically coupled to the switch blades 20, 22.

The input terminals 36A, 36B are connected to the DC power supply 41 via two supplying electric cables 42A, 42B, corresponding, for example, to a phase conductor 42A and a neutral conductor 42B, and to receive a power signal from the DC power supply 41. The power supply is, for example, located several hundred meters distant from the motor assembly 26. The power supply comprises, for example, a bank of battery and delivers a supply current IS1 to the motor assembly 26.

The regulation unit 38 generates, from the power signal on the input terminals 36A, 36B, a motor current applied to the electric motor 34.

The regulation unit 38 is configured to adapt the power signal between the input terminals 36A, 36B into the motor current applied to the electric motor 34.

As shown in FIG. 2, the regulation unit 38 comprises four transistors 44A, 44B, 44C, 44D connected in an H bridge configuration between the input terminals 36A, 36B and the phases 40A, 40B of the electric motor 34.

The regulation unit 38 comprises a motor current sensor 48, located on a central branch of the H bridge in series with the first phase 40A of the electric motor 34, to measure the intensity IM1 of a motor current supplied to the electric motor 34.

The regulation unit 38 comprises also identifying means 50, such as an identification sensor, configured to identify an instantaneous state of the railroad switch machine during the movement of the switch blades 20, 22 from an initial position, corresponding to the direct position or the deviated position, to a final position, corresponding to the deviated position or the direct position.

The regulation unit 38 comprises a control device 52 driving each transistor 44A, 44B, 44C, 44D with a respective command signal SA, SB, SC, SD.

The respective command signals SA, SB, SC, SD are advantageously pulse width modulation signals.

The transistors 44A, 44B, 44C, 44D connect the motor 34 to the input terminals 36A, 36B based on the respective command signal SA, SB, DC, SD.

The transistors 44A, 44B, 44C, 44D are driven between a closed state in which they are equivalent to a close switch and an open state in which they are equivalent to an open switch.

The transistors 44A, 44B, 44C, 44D are, for example, metal-oxide-semiconductor field-effect transistors (MOSFET).

According to their close or open state the transistors 44A, 44B, 44C, 44D command the passage of the current through the motor 34, said motor current being characterized by an intensity IM1 defined by an absolute value and a direction through the motor through the motor 34.

More especially, when the transistors 44A, 44C are in the closed state and the transistors 44B, 44D are in the open state, the intensity of the motor current IM1 flows in a first direction and command the rotation of the electric motor 34 in a first way. Thus, the switch blades 20, 22 move, for example, towards the direct position.

When the transistors 44B, 44D are in the closed state and the transistors 44A, 44C are in the open state, the intensity of the motor current IM1 flows in a second direction or reverse direction, opposite to the first direction, and command the rotation of the electric motor in an other way. Thus, the switch blades 20, 22 move, for example, towards the deviated position.

The alternate command of the pairs of switches 44A, 44C and 44B, 44D according to different values of a duty cycle will allow the regulation of the value of the intensity of the motor current.

When the transistors 44A, 44B, 44C, 44D are all in the open state, the intensity of the motor current IM1 is null and the motor is motionless.

The identifying means 50 are configured to identify the instantaneous state of the switch machine among at least three different states of the railroad switch machine 14 that successively occurred during the movement of the switch blades 20, 22 from the initial position to the final position. The path followed by the switch blades 20, 22 relative to the corresponding stationary blades 16, 18 is subdivided in three successive intervals, i.e. a first, a second and a third intervals, between the initial and the final position. Then the three possible states are:

- A starting state, during which the motor 34 starts to spin and the switch blades 20, 22, have traveled relative to the stationary rails 16, 18, on a first distance comprised in the first interval. In the starting state a voltage, is applied to the motor 34, i.e. to terminals of the motor 34, and as the motor begins turning there is very little counter electromotive force generated by the motor to oppose the voltage at the terminals of motor 34.
- A normal operating state, during which the switch blades 20, 22 have traveled relative to the stationary rails 16, 18 on a second distance comprised in the second interval. In the normal operating state, the motor 34 is spinning rapidly, at a nominal angular velocity. The counter electromotive force generated by the spinning motor 34 will limit the voltage applied across the motor 34, i.e. across winding of the motor 34, and therefore limit motor current and motor torque.
- An ending state, during which the switch blades 20, 22 have traveled relative to the stationary rails 16, 18 on a third distance comprised in the third interval. In the ending state, the switch blades are close to the final position, the motor load increases compared to the normal operating state, and the motor 34 slows down to stop when the switch blades 20, 22 are in the final position. In the ending state, as the motor 34 slows down, there is little counter electromotive force to oppose the voltage of the motor current.

The identification sensor 50 can be, for example, a position sensor configured to measure the position of the switch blades 20, 22 relative to the stationary rails 16, 18 and to transmit position information to the control device 52. The position of the switch blades 20, 22 is typically determined by limit switches which detect the position of displacement element 28.

The control device 52 comprises a reception organ 55 and a calculating unit 56.

The reception organ 55 receives command instructions of moving the switch blades 20, 22 from a remote central controller (not shown on the figure).

Calculating unit 56 is implemented in hardware and comprises programmable logic components.

Alternatively calculating unit 56 comprises dedicated integrated circuits.

Alternatively calculating unit 56 is implemented by means of a programmable computer comprising a processor and an information medium storing programming code instructions. In this alternative, the processor executes the programming code instructions saved by the information medium and the programming code instructions form a computer program configured to be executed by the processor.

The calculation unit 56 is configured to limit the motor current below a predetermined motor current limit setpoint CLSM1 of the railroad switch machine 14.

The predetermined motor current limit setpoint CLSM1 corresponds to a predetermined desired maximal absolute value of the intensity of the motor current IM, which directly corresponds to a maximal motor torque output by the DC electrical motor 34. In the proposed invention, motor torque is limited to a predetermined maximal value thanks to the calculation unit 56.

The value of the predetermined motor current limit setpoint CLSM1 is, for example, equal to 20 Amperes.

Calculating unit 56 is configured to drive each transistor 44A, 44B, 44C, 44D, i.e. to generate each respective command signal SA, SB, SC, SD, in function of the intensity measured by the motor current sensor 48 and, advantageously, also in function of the predetermined motor current limit setpoint CLSM1, to regulate the value of the intensity of the motor current IM1 delivered to the electric motor 34 to be below the current limit setpoint CLSM1.

More especially, calculating unit 56 is configured to identify the instantaneous state of the railroad switch machine 14 in function of the positions of the switch blades 20, 22 detected by the identifying means 50 and to drive each transistor 44A, 44B, 44C, 44D in order to limit the value of the motor current through motor 34 below the value of the predetermined motor current limit setpoint CLSM1.

Figure 3:
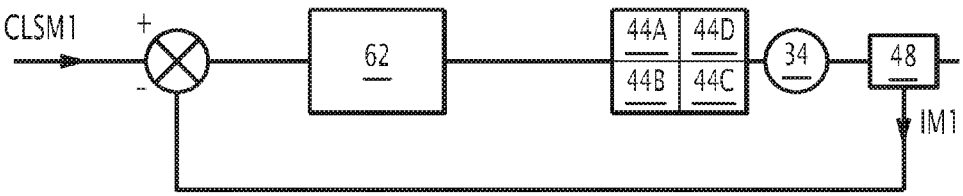
FIG. 3 is a block diagram representing the regulation of the intensity of a motor current going through the electric motor of FIG. 2.

More precisely, as shown on FIG. 3, the calculating unit 56 calculates and generates the respective command signals SA, SB, SC, SD of the transistors 44A, 44B, 44C, 44D in function of a difference between the intensity of the motor current IM1 measured by the motor current sensor 48 and the value of the predetermined motor current limit setpoint CLSM1. The respective command signals SA, SB, SC, SD are calculated using, for example, a proportional-integral-derivative controller 62 (PID controller) and are applied to the transistors 44A, 44B, 44C, 44D.

Calculating unit 56 is also configured to stop the motor 34 if, while the switch blades 20, 22 are commanded to move towards the direct position, the position detector detects that the left switch blade 20 is already in the direct position. Inversely calculating unit 56 is configured to stop the motor 34 if, while the switch blades 20, 22 are commanded to move towards the deviated position, the position detector detects that the right switch blade 22 is already in the deviated position.

The functioning of the control device 52 will be explained in more details below using FIGS. 3 to 5.

Figure 4:
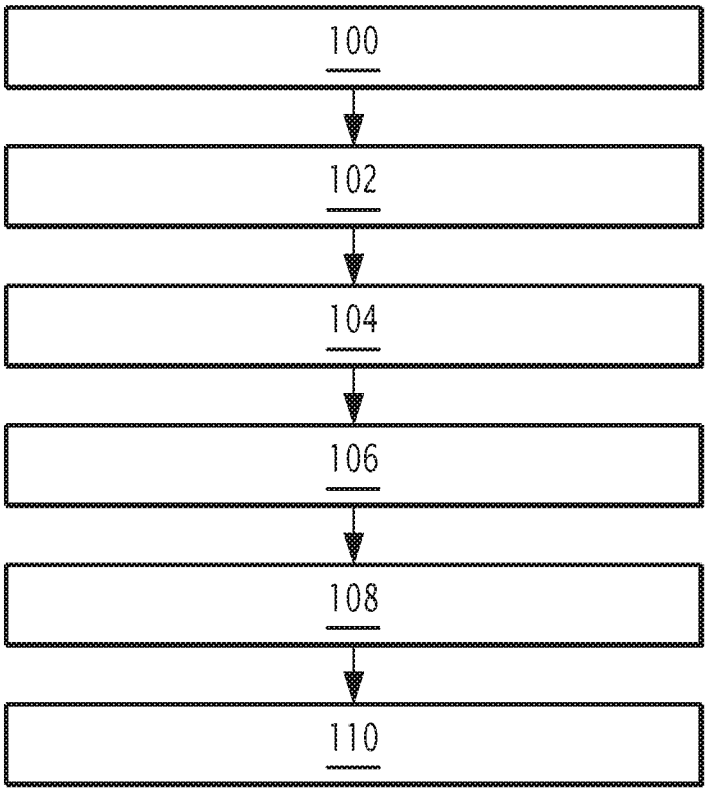
FIG. 4 is a flowchart of an example of method for controlling the motor of FIG. 2.

As shown on FIG. 4, the method for controlling the motor comprises first an initial step 100, then further measuring 102, starting 104, operating 106, ending 108 and final 110 steps.

Figure 5:
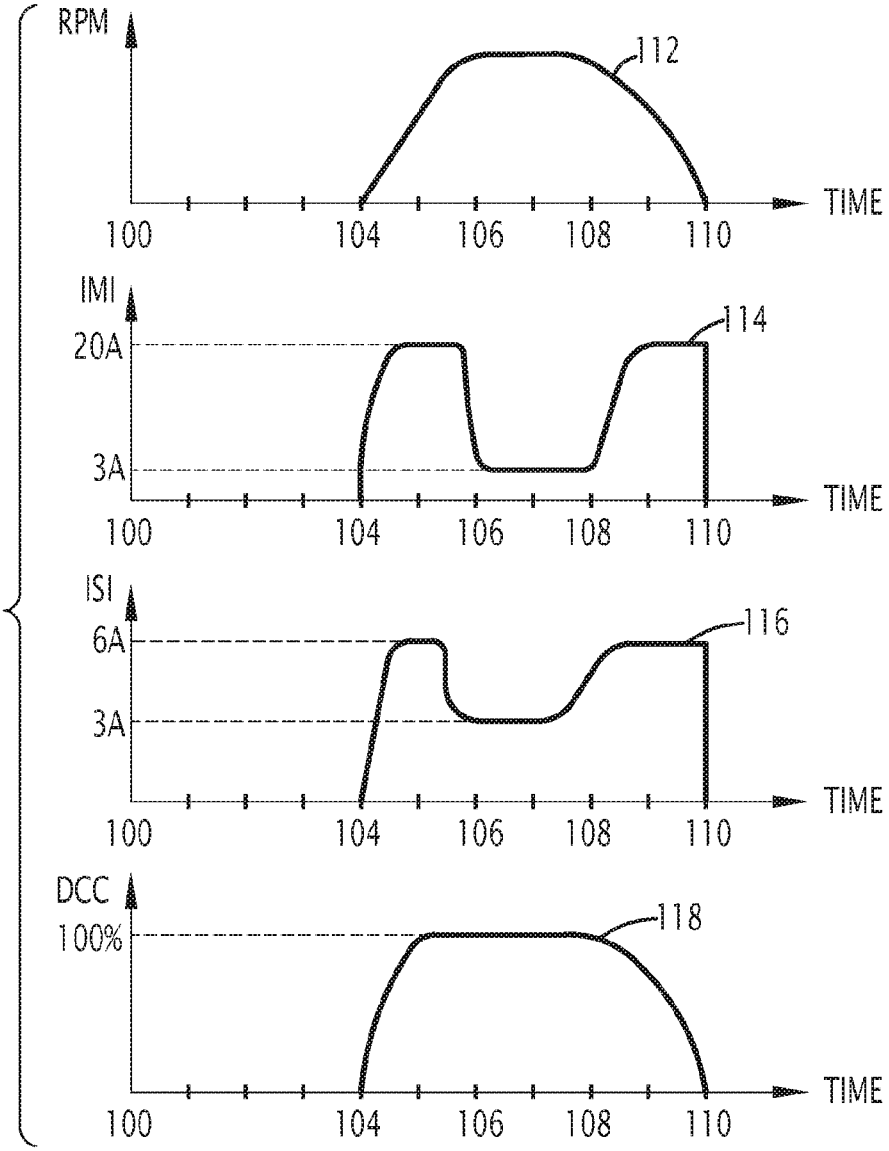
FIG. 5 shows four graphs representing the number of rotation per minute of the electric motor of FIG. 2, the motor current across the electric motor, the supply current supplied to the motor assembly of FIG. 2 and a pulse width modulation duty cycle of a transistor driving the electric motor, both in function of time, while switch blades of the railroad switch machine are moved from a deviated position towards a direct position.

FIG. 5 shows four curves 112, 114, 116 and 118 corresponding respectively to the number of rotation per minute (RPM) of the motor 34, the value of the motor current IM1, the value of the supply current IS1 and the duty cycle DCC of the command signal SC in function of time, during steps 100 to 108. On FIG. 5, initial step 100, then further starting 104, operating 106, ending 108 and final 110 steps are indicated on the time line, i.e. on the horizontal axis of the graphs.

During the initial step 100, the control device 52 receives, through the reception organ 55 and from the central controller, a command instruction of moving the switch blades 20, 22 towards the deviated or the direct position. In our example, the method for controlling the motor will be presented in the case where the control device 52 receives a command instruction of moving the switch blades 20, 22 into the direct position, whereas the switch blades 20, 22 are initially in the deviated position.

In the further measuring step 102, the motor current sensor 48 measures the intensity of the motor current IM1 and the identifying means 50 measures the position of the switch blades 20, 22. This step is, for example, performed periodically with a period, for example, equal to 0.5 second.

Then, during the starting step 104, calculating unit 56 identifies that the switch machine 14 is in the starting state and calculates the respective command signals SA, SB, SC, SD, in function of the difference between the measured intensity of the motor current IM1 and the value of the predetermined motor current limit setpoint CLSM1. During the starting step, the motor begins turning slowly and then accelerates as shown on curve 112. As the motor begins to turn, there is minimum counter electromotive force, and if motor 34 was connected to input terminals 36A, 36B continuously, motor current and torque would quickly increase to a large value that could damage the motor or the switch machine mechanism. In this mode of operation the control device 52 commands each transistor 44A, 44B, 44C, 44D, utilizing pulse width modulation to limit the intensity of the motor current IM1 to the value of the predetermined motor current limit setpoint CLSM1, as shown on curves 114 and 116. There are several different well-known timing schemes for pulse width modulation of H bridge switches 44A,44B, 44C,44D for bidirectional motor drivers, including two-quadrant chopping, four-quadrant chopping, and enable chopping. Below is a description of operation using two-quadrant chopping, although other timing schemes could be utilized.

More especially, during the starting step 104, the command signal SC of transistor 44C is a pulse width modulation signal, having a duty cycle less than 100%, and the command signal SA is set to keep transistor 44A closed. The command signals SB and SD are set to keep transistors 44B and 44D open.

As shown on FIG. 5, on curve 118, during the starting step 104, the value of duty cycle of the command signal SC starts from value 0 and increases to reach the value 100%, where the switch machine is in the normal operating state.

After the motor has accelerated enough so that counter electromotive force limits the current and torque delivered by the motor, operating step 106 begins. More especially, the calculating unit 56 identifies that the switch machine 14 is in the normal operating state and calculates the respective command signals SA, SB, SC, SD. In this mode the motor current is below the motor current limit setpoint CLSM1 and is, for example, equal to 3 A as shown on curve 114. In this case the control device 52 drives each transistor to connect the electric motor 34 to the input terminals 36A, 36B continuously, in order to apply a voltage of maximum absolute value to the electric motor 34. In other words, during the operating step 106, if the motor 34 is commanded to move the switch blades towards the direct position, the calculating unit 56 maintains the transistors 44A and 44C in the closed state and transistors 44B and 44D in the open state, i.e. the duty cycle of the command signals SA and SC is equal to 100%; and if the motor 34 is commanded to move the switch blades towards the deviated position, the calculating unit 56 is configured to maintain the transistors 44B and 44D in the closed state and the transistors 44A and 44C in the open state.

Then, during the ending step 108, following the normal operating step 106 and identified by the calculating unit 56, displacement element 28 has moved the switch blades close to the ending point of travel. In this interval the torque load to the motor increases as the displacement element 28 compresses the switch blades against the stationary rails to reach the final position, the motor slows down as shown on curve 112, and the motor current IM1 must be limited to avoid damage to the motor 34 or switch machine 14. During the ending step 108, the control device commands each transistor 44A, 44B, 44C, 44D to adjust the intensity of the motor current IM1 to the value of the predetermined motor current limit setpoint CLSM1, as shown on curve 114. In this case the H bridge switching control is the same as in step 104. More especially, the command signals SC of transistor 44C is a pulse width modulation signal having, for example, a duty cycle shown on curve 118 starting from value 100% and decreases to reach the value 0, where the final step 110 is reached and the switch blades are in the direct position. The command signal SA is set to keep transistor 44A in the closed state and the command signals SB and SD are set to keep transistors 44B and 44D in the open state.

Alternatively, if the control device 52 receives a command instruction of moving the switch blades 20, 22 into the deviated position, whereas the switch blades 20, 22 are initially in the direct position, the transistors 44A, 44B, 44C, 44D are driven to reverse the direction of current flow through the motor. In this case the command signal SB of transistor 44B is a pulse width modulation signal and the command signal SD is set to keep transistor 44D closed. In this case command signals SA and SC are set to leave transistors 44A and 44C open.

As shown on FIG. 3, during the starting 104, normal operating 106 and ending 108 steps, the calculating unit 56 could implement a control feedback loop: the PID controller 62 generates the respective command signals SA, SB, SC, SD in function of the measured intensity of the motor current IM1 and the value of the predetermined motor current limit setpoint CLSM1. In other words, the control device 52 comprises a first feedback loop on the intensity of the motor current. It has to be noted that calculating unit 56 is configured so that if the measured motor current IM1 is less than the motor current limit setpoint CLSM1, calculating unit 56 will drive each transistor to connect the electric motor to the input terminals 36A, 36B continuously.

During the starting step 104 and the ending 108 steps, the control of the transistors 44A, 44B, 44C, 44D in function of the value of the predetermined motor current limit setpoint CLSM1 allows to limit the torque produced by the motor 34, to avoid developing excessive motor torque which could damage the gear box and/or the displacement element 28 and/or the tie rod 24. Indeed the control of the transistors 44A, 44B, 44C, 44D allows controlling the motor current and it is known that the motor torque of an electric motor 34 is proportional to the value of the intensity of the motor current IM1 going through the motor 34. Such a control is essential because, when the switch machine 14 is in the starting state 104 the motor torque is limited only by the resistance of the motor 34 and can increase in a dangerous manner for the switch machine 14. In the same manner, when the switch machine is in the ending state 108, the motor load typically increases significantly as the switch blades 20, 22 are driven to their final position and the motor torque could become excessive and damage the motor 34.

During the operating step 106, the control of the transistors 44A, 44B, 44C, 44D is not directly used to limit the motor torque and the transistors 44A, 44C are maintained in the closed state, because the motor is spinning rapidly and the counter electromotive force generated by the spinning motor will limit the intensity of the motor current IM1 and consequently the motor torque.

Regulation unit 38, the motor 34, and the capacitor 39 form a buck DC-DC converter. The benefits of the buck converter are significant. As shown on curves 114 and 116 of FIG. 5, in the proposed invention, the intensity of the supply current IS1 drawn is less than 6 A and this allows delivering a motor current IM1 with an intensity of 20 A. A buck converter produces the same power at the output as is consumed at the input, neglecting relatively small losses in efficiency due to non-ideal components. In the example, the power drawn from the power supply when the motor reaches end of travel is equal to 6 A×24V=144 W. Neglecting buck converter losses, the motor power is thus 144 W. In this case, since the motor current is 20 A, the voltage across the motor terminals is 144 W/20 A=7.2V. In other words, when motor 34 slows down due to increased torque load, e.g. at end of travel, the counter electromotive force developed by the motor is relatively small, the voltage output from the buck converter is reduced, and the current drawn from the power supply is reduced.

As previously explained, the supply current is typically supplied by batteries, and the buck DC-DC converter allows reducing the economic and environmental cost of buying and maintaining the power supply. Indeed the buck DC-DC converter allows to reduce the value of the supply current required to operate the switch machine, and therefore reducing the amount of batteries required for supplying the supply current.

In addition, supplying electric cables capable of supplying 20A which must be relatively thick, e.g. AWG6, and are expensive are not necessary. Indeed the use of the buck DC-DC converter allows to use supplying electric cables 42A, 42B configured to supply only 6 A and not 20 A, i.e. less thick and less expensive.

More generally, the value of the intensity of the motor current is globally equal to the inverse of the duty cycle of the command signal SC when the switch blades 20, 22 are moved in the direct position and to the inverse of duty cycle of the command signal SB when the switch blades 20, 22 are moved in the deviated position.

Therefore the control device 52 allows a precise control of the intensity of the motor current IM1 and therefore of the motor torque to avoid any damage of the switch machine 14.

Alternatively, the identifying means 50 comprises, for example, a speed sensor configured to measure the electric motor 34 angular velocity and the control device 52 is configured to identify the instantaneous state of the railroad switch machine 14 in function of the measured motor angular velocity. Indeed the angular velocity of the motor is different according to the state of the railroad switch machine 14, because the load presented to the motor 34 varies according to the position of the switch blades, i.e. according to the state of the railroad switch 14.

Alternatively the identifying means 50 are counter electromotive force sensors.

In field operation, obstructions on the railroad track, such as rocks or ice, could cause the switch blades 20, 22 to jam, which will cause the motor to stall. In this stall condition, the control device 52 is configured to drive the transistors 44A, 44B, 44C, 44D in function of the value of the predetermined motor current limit setpoint CLSM1 to limit the value of the intensity of the motor current IM1 and prevent damage of the switch machine 14.

In the following, a second embodiment of the invention, as presented on FIGS. 6 to 8 will be described.

Figure 6:
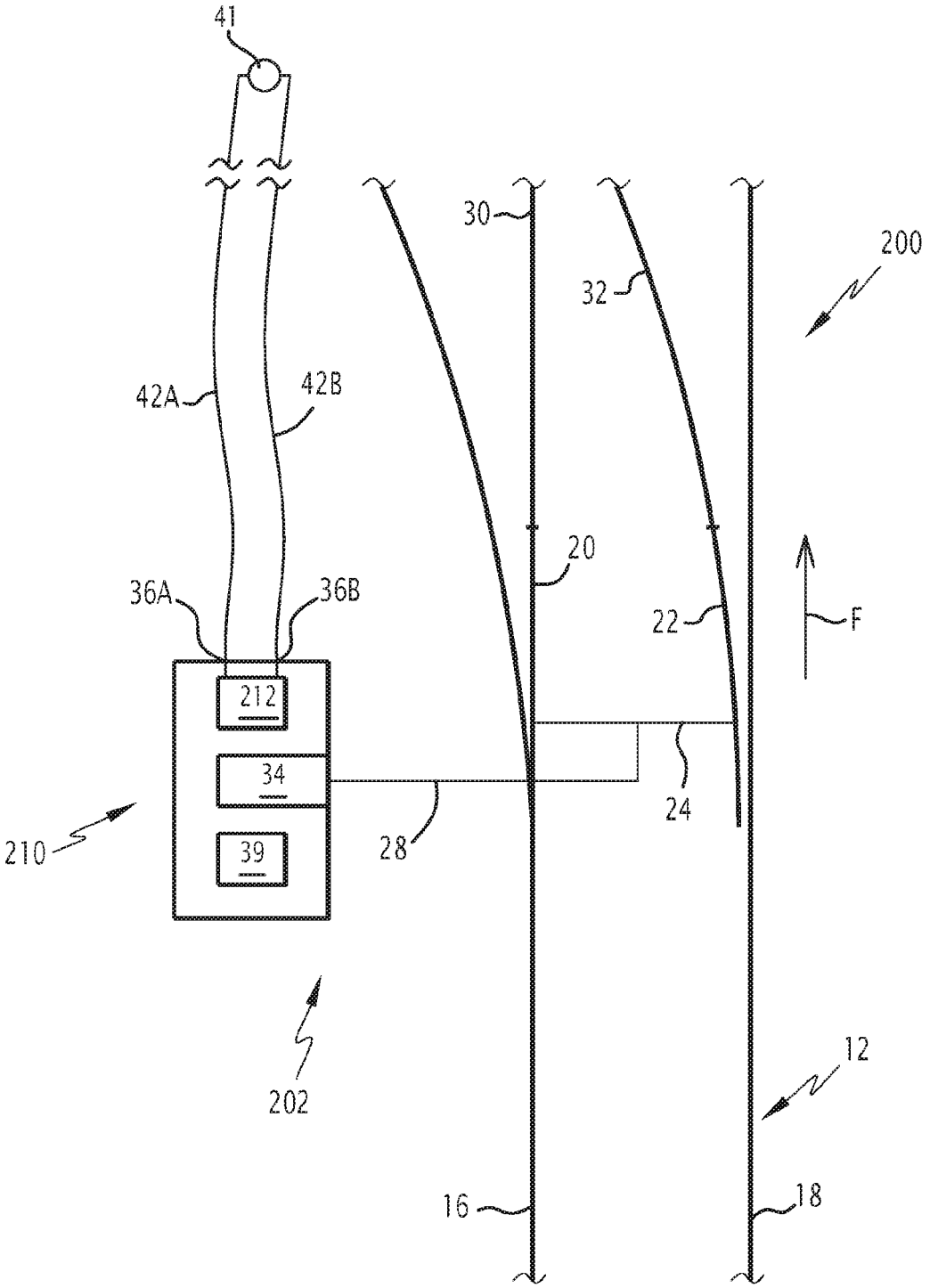
FIG. 6 is similar to FIG. 1 and represents a railroad installation comprising a railroad track and a railroad switch machine according to a second embodiment of the invention.

FIG. 6 represents a railroad installation 200 comprising a railroad track 12 and a railroad switch machine 202 according to the second embodiment of the invention.

The railroad installation 200 represented in FIG. 6 is globally similar to the one represented on FIG. 1 and the similar elements have the same references.

The railroad switch machine 202 includes a left switch blade 20 and a right switch blade 22 which are linked by one tie rod 24, a motor assembly 210 and a displacement element 28 linking the motor assembly 210 to the tie rod 24

The railroad switch machine 202 is globally similar to the railroad switch machine 14. Such a railroad switch machine 202 differs from the railroad switch machine 14 according to the first embodiment only by its motor assembly 210.

Figure 7:
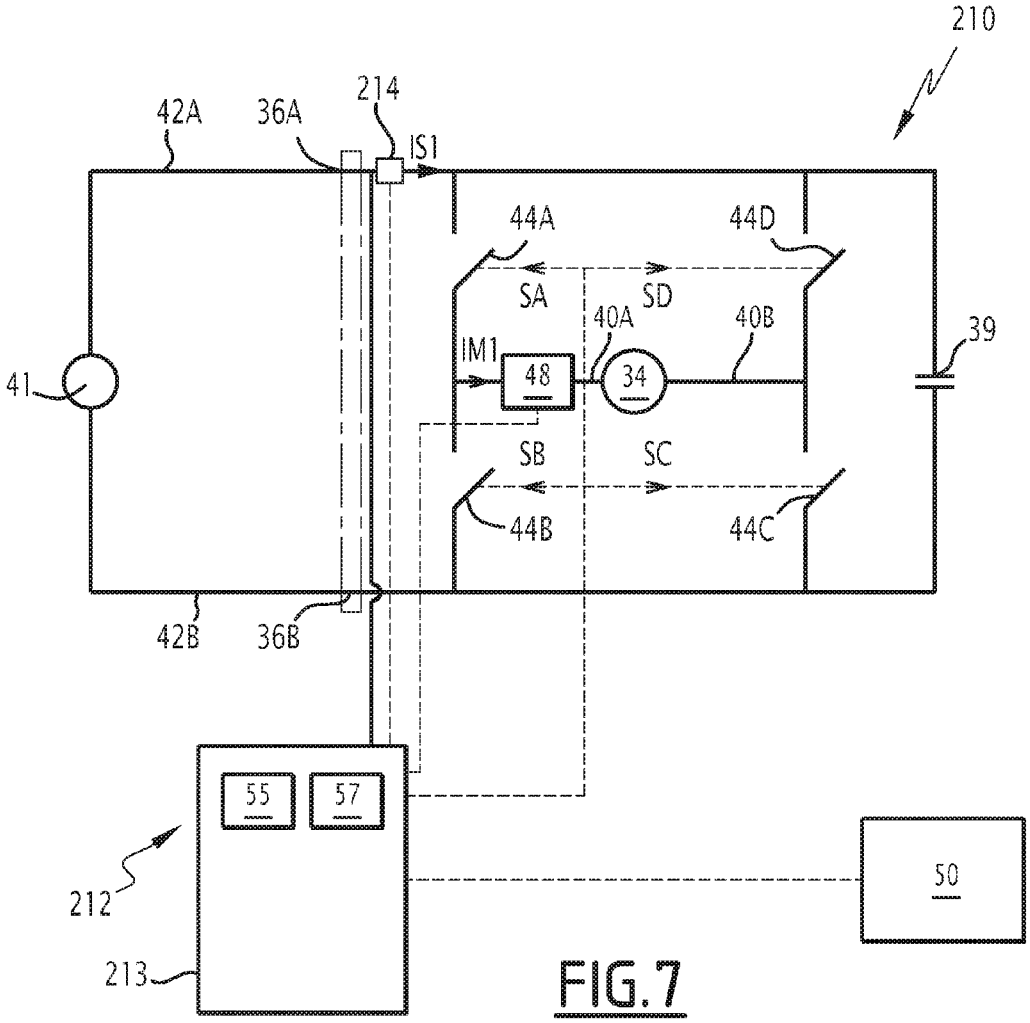
FIG. 7 is similar to FIG. 2 and represents a motor assembly of the railroad switch machine of FIG. 6.

The motor assembly 210, represented on FIG. 7, is globally similar to the motor assembly 26 and the similar elements between the two motor assemblies 210, 26 will have the same reference numbers.

In the following, only the difference between the first embodiment and the second embodiment will be presented.

The motor assembly 210 comprises an electric motor 34, input terminals 36A, 36B, a capacitor 39 and a regulation unit 212.

The regulation unit 212 comprises transistors 44A, 44B, 44C, 44D, a motor current sensor 48 located on a central branch of the H bridge in series with the first phase 40A of the electric motor to measure the intensity of the motor current IM1, identifying means 50, a control device 213 driving each transistor 44A, 44B, 44C, 44D with a respective command signal SA, SB, DC, SD and a supply current sensor 214 located on a feed branch of the H bridge, just behind the input terminal 36A to measure the intensity of a supply current IS1 received on the input terminals.

The control device 213 comprises a reception organ 55 and a calculating unit 57 which is different than in the first embodiment. As with the first embodiment, calculating unit 57 may be implemented in hardware, or by means of a programmable computer.

The supply current sensor 214 is configured to measure the power signal received on the input terminals and notably the intensity of power signal, i.e. the intensity of the supply current IS1. In the following, the intensity of the power signal and the intensity of the supply current IS1 corresponds to the same thing.

Calculating unit 57 is similar to calculating unit 56 and differs only in that it further takes into account the measured intensity of the supply current IS1, to provide optimized control of the transistors 44A, 44B, 44C, 44D.

Calculating unit 57 is configured to drive each transistor 44A, 44B, 44C, 44D, i.e. to generate each respective command signal SA, SB, SC, SD, in function of the intensity measured by the motor current sensor 48 and of the intensity measured by the supply current sensor 214 and, advantageously, also in function of the predetermined motor current limit setpoint CLSM1, to regulate the value of the intensity of the motor current IM1 supplied to the electric motor 34.

More especially, as shown on FIG. 7, calculating unit 57 is configured to drive each transistor 44A, 44B, 44C, 44D in function of the intensity of the motor current IM1 and of the intensity of the supply current IS1, providing a feedback control of the motor through a first feedback loop based on the intensity of the motor current IM1 and a second feedback loop based on the intensity of the supply current IS1. The control device 213 is thus a cascade controller.

In other words, the control device 213 comprises a first feedback loop on the intensity of the motor current and a second feedback loop on the intensity of the supply current so as to form a cascade controller.

Calculating unit 57 is configured to calculate a supply current setpoint CS1 in function of the measured intensity of the motor current IM1 and of the predetermined motor current setpoint CM1, and to command each transistor 44A, 44B, 44C, 44D in function of the measured intensity of the supply current IS1 and the supply current setpoint CS1, in order to maintain the value of the intensity of the supply current IS1 equal to the value of the supply current setpoint CS1 and to limit the value of the intensity of the motor current IM1 to the value of the predetermined motor current setpoint limit CLSM1.

Figure 8:
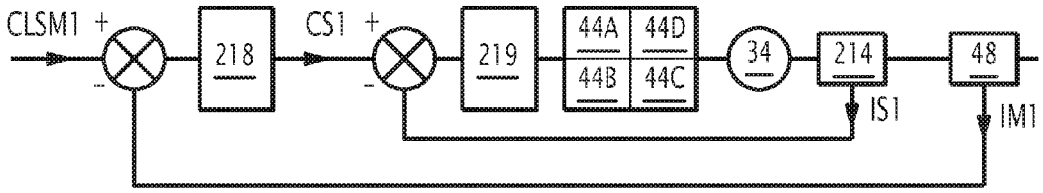
FIG. 8 is a block diagram representing the regulation of the intensity of a motor current going through an electric motor of the motor assembly of FIG. 7.

The supply current setpoint CS1 and the command signals SA, SB, SC, SD are calculated using, for example, two proportional-integral-derivative controllers 218, 219 (PID controller) shown on FIG. 8.

More precisely, the proportional-integral-derivative controller 218 calculates the value of the supply current setpoint CS1 as a function of the measured value of the intensity of the motor current IM1 and the value of the predetermined motor current limit setpoint CLSM1.

The proportional-integral-derivative controller 219 calculates the command signals SA, SB, SC, SD as function of the measured value of the intensity of the supply current IS1 and of the value of the supply current setpoint CS1.

In both embodiments of the invention, the control of transistors 44A, 44B, 44C, 44D to control the motor current allows limiting the motor torque applied to the displacement element 28 to avoid any damage of the switch machine 14.

Besides, the fact to control the intensity of the motor current IM1 with transistors 44A, 44B, 44C, 44D which are switching provides a fast and reliable control of the motor current IM1.

Moreover, the use of the internal inductance of the electric motor 34 as an inductor for the buck DC-DC converter, allows to avoid the use of a supplementary independent inductor in the motor assembly 26, which for the current required, e.g. 20 A, is generally a large, heavy, expensive and relatively fragile inductor.

Furthermore the use of the regulation unit 38 allows an optimal functioning of the switch machine 14 with a limited maintenance. More especially it allows a switch machine 14 to be built without a mechanical torque-limiting clutch adapted to slip when a torque produced by the electric motor 34 exceed a predetermined value. Such a clutch is expensive, subject to wear, and requires regular maintenance.

Finally, the use of a pulse width modulation command signal having a duty cycle different than 100% in the ending state allows increasing the current going through the motor 34 while limiting the intensity of the supply current IS1 supplied to the motor assembly 26. In the example of FIGS. 2 and 7, when the duty cycle of the command signal SA is equal to 0.3, the intensity of the supply current IS1 is, for example, equal to 6 A whereas the intensity of the motor current IM1 is equal to 20 A. Therefore the current going from the DC power supply 41 to the motor assembly 26 is limited which allows to optimize the operating life and to minimize the required maintenance of the DC power supply 41.

In the second embodiment, the use of two feedback loops allows to smoothly control the supply current IS1 as well as motor current IM1. The two feedback loops are, for example, proportional-integral-derivative loops. The two feedback loops are a supply current control loop also called the inner loop and a motor current control loop also called the outer loop.

Indeed, it is important to smoothly control the supply current IS1, because the supplying cables 42A, 42B are generally long cables, up to hundreds of meters in length, which implies that the installation could present a relatively large inductance between the power supply 41 and the input terminals 36A, 36B. In this case, rapid fluctuations in supply current applied across the large cable inductance would produce large voltage fluctuations at the input terminals 36A, 36B, which could cause instability in the control loop or damage the controller. As shown on FIG. 8, the supply current control loop regulates the current to supply current setpoint CS1, which limits the fluctuations of supply current IS1.

The second embodiment of the invention uses a cascade control loop to perform the two important functions required of the controller, which are limiting the intensity of the motor current to a predetermined setpoint CLSM1, and regulating the intensity of the supply current to a relatively slowly varying setpoint CS1. The invention described uses a simple cascade control loop to achieve these functions.

Other well-known classical and modern control techniques could also be utilized to implement these functions. For example a state-space controller could be used in place of the cascade controller.

The embodiments and variants discussed above are suitable for being combined with one another wholly or partially to give rise to other embodiments of the invention.

What is claimed is:

1. A railroad switch machine comprising:

a pair of switch blades, an electric motor, the electric motor being a reversible motor having two phases, the electric motor being mechanically coupled to the pair of switch blades to move the switch blades relative to a pair of stationary rails, a pair of input terminals, connected to a DC power supply for receiving a power signal, a regulator to adapt the power signal between the input terminals into a motor current applied to the electric motor, said regulator comprising a plurality of switches connected in an H bridge configuration between the pair of input terminals and the two phases of the electric motor, wherein the switches are transistors and the regulator comprises a controller adapted to drive each transistor with a respective command signal to adjust a value and a direction of an intensity of the motor current.

2. The railroad switch machine of claim 1, wherein each respective command signal is a pulse width modulation signal.

3. The railroad switch machine of claim 1, wherein the regulator comprises a motor current sensor configured to measure the intensity of the motor current applied to the electric motor and wherein the controller drives each transistor in function of the intensity of the motor current, to regulate the intensity of the motor current supplied to the electric motor.

4. The railroad switch machine of claim 3, wherein the controller is adapted to drive each transistor also in function of a predetermined motor current limit setpoint, to limit the intensity of the motor current below the predetermined motor current limit setpoint, providing a feedback control of the intensity of the motor current.

5. The railroad switch machine of claim 4, wherein the electric motor is adapted to move the switch blades relative to stationary rails from an initial position to a final position, the regulator comprising an identification sensor adapted to identify an instantaneous state of the railroad switch machine among:

a starting state, during which the motor starts to spin and the switch blades have traveled relative to the stationary rails on a first distance comprised in a first interval, a normal operating state, during which the switch blades have traveled relative to the stationary rails on a second distance comprised in a second interval following the first interval, and an ending state, during which the switch blades have traveled relative to the stationary rails on a third distance comprised in a third interval following the second interval, and wherein the controller is configured to adapt the value of the predetermined motor current limit setpoint, depending on the instantaneous state of the electric motor.

6. The railroad switch machine of claim 5, wherein during the normal operating state the controller drives each transistor to connect the electric motor to the input terminals continuously, in order to apply a voltage of maximum absolute value to the electric motor.

7. The railroad switch machine of claim 5, wherein during the starting and ending operating states the controller drives each transistor to limit motor current to the predetermined motor current limit setpoint.

8. The railroad switch machine of claim 3, wherein the regulator comprises a supply current sensor configured to measure an intensity of the power signal received on the input terminals, wherein the controller drives each transistor also in function of the intensity of the power signal, the regulator comprising a first feedback loop on the intensity of the motor current and a second feedback loop on the intensity of the power signal, the regulator thus forming a cascade controller.

9. The railroad switch machine of claim 1, wherein the railroad switch machine includes a capacitor connected in parallel with the input terminals.

10. The railroad switch machine of claim 1, wherein the regulator, the motor and the capacitor forms a buck DC-DC converter devoid of independent inductor and wherein an internal inductance of the electric motor is used as an inductor for the buck DC-DC converter.

11. The railroad switch machine of claim 1, wherein the railroad switch machine is devoid of a mechanical torque-limiting clutch.

* * * * *